United States Patent [19]

Sugasawa et al.

[11] 4,224,920

[45] Sep. 30, 1980

[54] SPLIT ENGINE OPERATION WITH MEANS FOR DISCRIMINATING FALSE INDICATION OF ENGINE LOAD REDUCTION

[75] Inventors: Fukashi Sugasawa, Yokohama; Haruhiko Iizuka; Junichiro Matsumoto, both of Yokosuka; Yukihiro Etoh, Yokohama, all of Japan

[73] Assignee: Nissan Motor Company, Limited, Yokohama, Japan

[21] Appl. No.: 8,738

[22] Filed: Feb. 2, 1979

[30] Foreign Application Priority Data

Feb. 10, 1978 [JP] Japan ..... 53-16333

[51] Int. Cl.[3] ..... F02D 17/00

[52] U.S. Cl. ..... 123/198 F; 123/481

[58] Field of Search ..... 123/198 F, 32 EA, 32 EH, 123/32 EL, 32 ED

[56] References Cited

U.S. PATENT DOCUMENTS

| | | | |
|---|---|---|---|
| 3,955,363 | 5/1976 | Mandersheid | 123/198 F |
| 4,064,844 | 12/1977 | Matsumoto et al. | 123/198 F |
| 4,080,947 | 3/1978 | Tizuha | 123/198 F |
| 4,129,109 | 12/1978 | Matsumoto | 123/198 F |
| 4,144,864 | 3/1979 | Kato et al. | 123/198 F |

*Primary Examiner*—Ira S. Lazarus

*Attorney, Agent, or Firm*—Schwartz, Jeffery, Schwaab, Mack, Blumenthal & Koch

[57] ABSTRACT

A split engine control system includes a load level detector for generating a first signal in response to a relatively high engine load and a second signal in response to a relatively low engine load. A certain of the cylinders of an internal combustion engine is deactivated in response to the second signal to operate the engine on partial cylinders and activated in response to the first signal to permit the engine to operate on full cylinders. A discriminating circuit is connected to the load level detector to disable the second signal when the duration of the latter is smaller than a preset time interval which corresponds to the duration of a false indication of engine load reduction which might occur in response to gear changes during full cylinder operation.

6 Claims, 2 Drawing Figures

ELECTRONIC FUEL INJECTION CONTROL UNIT
10
ACCELERATION COMMAND SIGNAL, ETC.
P-V
12
F-V
15
11a
11b
13
14
16
Vcc
H
L
FF
J
C
K
Q
S
18
17
22
23
24
19
19a
SOLENOID
20
FUEL INJECTORS
#4, #5, #6
#1, #2, #3
FUEL INJECTORS
#1
#2
#3
#4
#5
#6
2
1
3
AIR

SPLIT ENGINE OPERATION WITH MEANS FOR DISCRIMINATING FALSE INDICATION OF ENGINE LOAD REDUCTION

BACKGROUND OF THE INVENTION

The present invention relates to split engine operation and in particular to an improvement to such operations.

In split engine operation a certain of cylinders of a multicylinder internal combustion engine is shut off when reduced engine power can adequately operate the vehicle. This allows the remainder cylinders to be operated at a point near the maximum efficiency so that light load fuel economy is greatly improved.

In an electronic fuel injection system split engine control is usually effected by disabling the fuel injection pulses, thereby shutting off the supply of fuel to deactivated cylinders. However, merely inhibiting the injection pulses would cause a pumping of air through the exhaust system of the engine, and if the system is provided with an exhaust gas sensor for closed loop operation, the exhaust gas concentration will no longer be an accurate representation of the air-fuel ratio of the mixture supplied to the engine. Therefore, in a prior art split-engine controlled fuel injection system, a shut-off valve is provided in the collect chamber of the intake manifold to prevent the admission of air to the deactivated cylinders. The usual practice of operating such shut-off valve involves sensing a load-representative manual command signal such as the duration of injection pulses. When the driver attempts to change gear ratios under relatively high engine load conditions, the sensing circuit would detect it as a reduction of load because of the momentary restoration of the accelerator pedal, causing the system to instantly change from full to partial cylinder modes. This is particularly disadvantageous for the split engine control using a shut-off valve since the false partial cylinder operation would continue for an extended interval because of the inherent delay operation of the shut-off valve.

The occurrence of such undesirable change to partial cylinder operation may be avoided by detecting disengagement of the clutch. However, a relatively complex mechanism and electrical circuitry would be required.

SUMMARY OF THE INVENTION

The split engine control system of the invention comprises a load level detector for providing a cylinder deactivating signal when reduced engine output power can adequately operate the vehicle. The invention contemplates the use of a discriminating circuit which checks the duration of the cylinder deactivating signal against a preset interval to selectively disable or enable the cylinder deactivating signal when its duration is respectively smaller or greater than the preset interval. The output of the discriminating circuit is coupled to a cylinder deactivating circuit which includes a bistable device responsive to the enabled cylinder deactivating signal to cut off the supply of fuel. When a gear change occurs during full cylinder operation, acceleration command signal momentarily indicates a reduction of engine load, causing a false cylinder deactivating signal to occur for the period of a short duration which is shorter than the preset interval. The false cylinder deactivating signal is disabled to allow the system to be only responsive to such cylinder deactivating signals when the latter continues for a longer period.

An object of the invention is to provide a split engine control system which discriminates a false indication of engine load reduction during full cylinder operation from valid indications of engine load reduction.

BRIEF DESCRIPTION OF THE DRAWINGS

The invention will be further described by way of example with reference to the accompanying drawings, in which.

DETAILED DESCRIPTION

Figure 1:
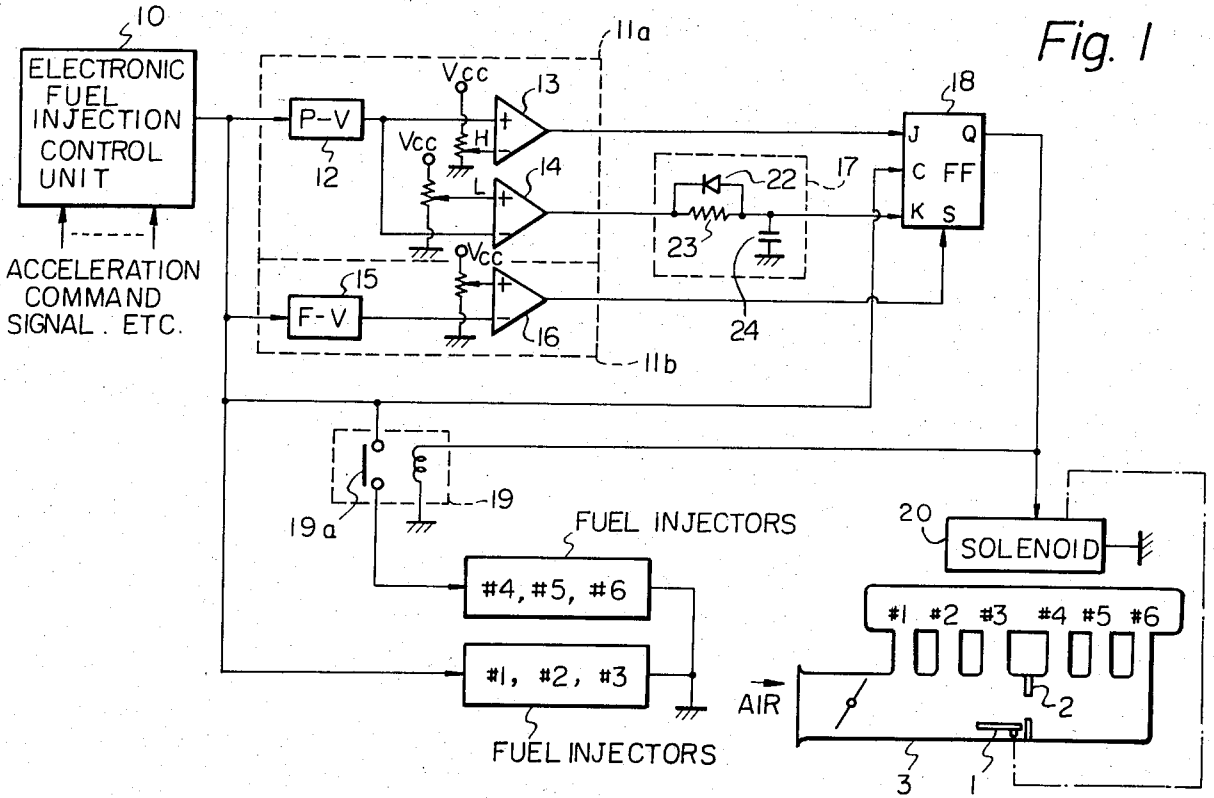
FIG. 1 is a circuit diagram of the split engine control system of the invention.

In FIG. 1 a split engine control system of the invention is schematically illustrated. Numeral 10 is an electronic fuel injection control unit of conventional design which generates injection pulses in response to ignition trigger pulses, the duration of the pulses being a function of various engine operating parameters such as engine-load representing manual command signal derived from the accelerator pedal or throttle valve, and other parameters including engine speed and temperature. For the purpose of disclosure there is shown a six cylinder internal combustion engine in which the fuel injectors for No. 1 to No. 3 cylinders are directly connected to the injection control unit 10, while the fuel injectors for No. 4 to No. 6 cylinders are connected thereto via the contact 19*a* of a disabling control relay 19.

The system includes an engine load detecting circuit 11*a* connected to the injection control unit 10, the circuit 11 comprising a pulse-width to voltage converter 12 which applies a voltage signal indicative of the injection pulse width and hence the magnitude of load to a noninverting input of a first comparator 13 as well as to the inverting input of a second comparator 14. The pulse-width-to-voltage converter essentially comprises an integrator and a sample-and-hold circuit which holds the integrated value of the injection pulses for the period of successive ignition intervals. The potential at the noninverting input of comparator 13 is compared with a reference voltage representing heavy engine load to provide a high voltage output when the noninverting input potential is higher than the reference voltage and a low voltage when the situation is reversed. On the other hand, the inverting input of comparator 14 is compared with a reference voltage representing light engine load to generate a high voltage output when the inverting input potential is lower than the reference voltage and a low output when the situation is reversed. Therefore, when the engine load is between the values for the heavy and light loads the comparators 13 and 14 both produce low voltage output signal.

An engine speed sensor 11*b* is provided which comprises a frequency-to-voltage converter 15 and a comparator 16. The frequency-to-voltage converter 15 essentially comprises a monostable multivibrator connected to be responsive to the injection control unit to provide a train of constant duration pulses in response to each injection pulse, and an integrator which provides integration of the constant duration pulses with respect to time. The output of the frequency-to-voltage converter 15 is supplied to the inverting input of the comparator 16 for comparison with a reference voltage corresponding to a predetermined low engine speed. When the sensed engine speed is lower than the reference speed, the comparator 16 provides a high voltage output.

A J-K flip-flop 18 receives the ouput signal from the comparator 13 at the J input terminal and the output signal from the comparator 16 at the set input terminal "S", and the injection pulses are applied to the clock input. The Q output terminal of the flip-flop 18 is connected to the relay 19 as well as to a shut-off valve operating solenoid 20. This solenoid operates a shut-off valve 1 to close the partition 2 provided in the intake manifold 3 to prevent the admission of intake air to cylinders No. 4 to No. 6 during the partial cylinder mode.

In accordance with the invention a pulse width discriminating circuit 17 is provided which includes a resistor 23 and a capacitor 24 which are connected in series between the output of comparator 14 and ground, the junction between resistor 23 and capacitor 24 being connected to the K input of the flip-flop 18. The resistor 23 is connected in parallel with a diode 22 which is poled in a sense to charge the capacitor 24 through the resistor 23 in response to the presence of an output signal from comparator 14 and to rapidly discharge it through the diode in response to the absence of said comparator 14 output.

The truth table of the flip-flop 18 is as follows: When the set input S is at a high voltage or "1" logic state indicating the engine speed is below the preset value the Q output goes into a logic "1" state regardless of the binary state of the J and K input terminals. With a logic "0" state at the set input indicating that the engine speed is higher than the preset value, the Q output is "1" in response to logic "1" at the J input and switches to "0" in response to a logic "1" at the K input. The logic 1 state of the output of flip-flop 18 represents a cylinder activating signal which energizes the relay 19 and solenoid 20 so that fuel injectors No. 4 to No. 6 are activated with injection pulses and the solenoid 20 opens the shut-off valve 1 to admit air into the cylinders No. 4 to No. 6, while the logic 0 state of the flip-flop represents a cylinder deactivating signal which de-energizes the relay 19 to deactivate the fuel injectors No. 4 and No. 6 and causes the solenoid 20 to close the shut-off valve 1 to prevent introduction of air to the cylinders No. 4 to No. 6. When the binary states of the J and K inputs change so that logic zeros appear simultaneously at these inputs as long as the set input is held at logic "0", the Q output maintains the previous binary state. The simultaneous presence of zeros at the J and K input will occur when the sensed engine load is in a range between the reference values set for the heavy and light loads as previously described, so that whenever the engine load changes from high to low values or vice versa the binary state of the flip-flop 18 remains unchanged to allow the system to continue the previous cylinder mode. This hysteresis action serves to prevent the system from shifting erratically between different cylinder modes when the engine load corresponds to a point at or near the threshold values of the comparators 13 and 14.

Figure 2:
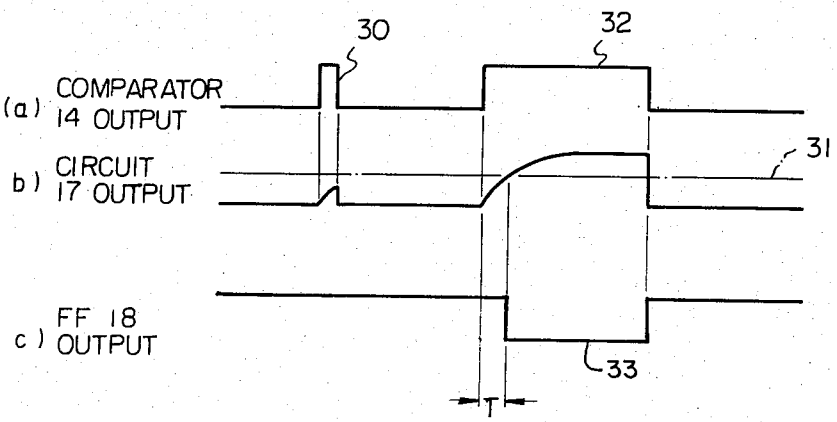
FIG. 2 is a waveform diagram associated with the discriminating circuit of FIG. 1.

The operation of the control system of the invention is best described with reference to waveforms shown in FIG. 2. When the vehicle driver attempts to change gear ratio during heavy load operation, the accelerator pedal is momentarily released, which is sensed by the comparator 14 to generate a pulse 30 of relatively short duration, FIG. 2*a*, and the capacitor 24 of pulse width discrimination circuit 17 is charged to a voltage level which is lower than the threshold level 31 of the K input of the flip-flop 18, FIG. 2*b*. Therefore, the short-duration pulse 30 is annihilated and the K input remains low. When the input signal to the circuit 17 continues as illustrated at 32, FIG. 2*a*, the capacitor 24 will be charged to a voltage level exceeding the threshold value of the K input, causing it to be biased to a logic "1" after the elapse of a delay interval T to permit the Q output to generate a logic "0" signal or cylinder deactivating signal 33 as shown in FIG. 2*c*.

When the comparator 14 output changes from logic "1" to logic "0", the diode 22 is rendered conductive to establish a low impedance path to rapidly discharge the capacitor 24.

The time constant value of the resistor 23 and capacitor 24 is properly selected to absorb the short duration pulse which is likely to occur during gear changes, so that undesirable cylinder mode changes is avoided without substantially sacrificing the fuel economy during gear change transient periods.

What is claimed is:

1. A split engine control system for an internal combustion engine having at least a first cylinder and a second cylinder, comprising:

means for generating high- or low-power representative signals in response, respectively, to an acceleration command becoming greater or smaller than a predetermined value;

a time constant electrical circuit responsive to said low-power representative signal for generating an output signal varying as a function of time; and a bistable device having a first input terminal responsive to said high-power representative signal for generating a cylinder activating signal to activate said at least first and second cylinders and a second input terminal responsive to said output signal from said time constant electrical circuit reaching a preset value for generating a cylinder deactivating signal to deactivate at least said second cylinder while allowing said at least first cylinder to remain activated.

2. A split engine control system as claimed in claim 1, wherein said time constant circuit comprises a resistor and a capacitor connected in series to develop a voltage across said capacitor for application to said second input terminal of said bistable device.

3. A split engine control system as claimed in claim 2, wherein said time constant circuit further comprises a diode connected in parallel with said resistor to provide a low impedance path to rapidly discharge said capacitor in response to the absence of said low-power representative signal.

4. A split engine control system as claimed in claim 1, wherein said means for generating high- or low-power representative signal comprises means for establishing high and low reference voltages representing respectively high and low engine power levels, means for generating a signal representative of the instantaneous value of engine output power, a first comparator for generating a first comparator signal when said instantaneous engine power signal is greater than said high reference voltage, and a second comparator for generating a second comparator signal when said instantaneous engine power signal is smaller than said low reference voltage, said first and second comparator signals corresponding respectively to said high- and low-power representative signals.

5. A split engine control system as claimed in claim 1, wherein said engine includes an electronic fuel injection system having at least first and second fuel injectors respectively for said at least first and second cylinders, further comprising means for detecting when the speed of said engine is below a predetermined speed, and wherein said bistable device comprises a J-K flip-flop having J, K, clock and set input terminals, and J input terminal being connected to be responsive to said high-power representative signal, the K input terminal being connected to said time constant electrical circuit, the clock input terminal being responsive to the injection pulses of said fuel injection system, and the set input terminal being connected to be responsive to the output of said speed detecting means to generate said cylinder activating signal.

6. A split engine control system as claimed in claim 1, wherein said engine includes a shut-off valve for preventing the admission of intake air to said second cylinder in response to said cylinder deactivating signal.

* * * * *